US010717557B2

(12) United States Patent
Miller et al.

(10) Patent No.: US 10,717,557 B2
(45) Date of Patent: Jul. 21, 2020

(54) VACUUM CLEANING UNIT FOR BLISTER PACKAGING

(71) Applicant: Team Technologies, Inc., Morristown, TN (US)

(72) Inventors: Ted Miller, Sharps Chapel, TN (US); Eric Crabtree, Talbott, TN (US); Matthew Schumaker, Talbott, TN (US); Bobby Mason, Morristown, TN (US)

(73) Assignee: Team Technologies, Inc., Morristown, TN (US)

( * ) Notice: Subject to any disclaimer, the term of this patent is extended or adjusted under 35 U.S.C. 154(b) by 243 days.

(21) Appl. No.: 16/053,433

(22) Filed: Aug. 2, 2018

(65) Prior Publication Data

US 2019/0039766 A1 Feb. 7, 2019

Related U.S. Application Data

(60) Provisional application No. 62/542,014, filed on Aug. 7, 2017.

(51) Int. Cl.

| | |
|---|---|
| ***B65B 55/24*** | (2006.01) |
| ***B65B 11/52*** | (2006.01) |
| ***B65B 9/04*** | (2006.01) |
| ***B65B 11/50*** | (2006.01) |

(52) U.S. Cl.

CPC ..... *B65B 55/24* (2013.01); *B65B 11/52* (2013.01); *B65B 9/045* (2013.01); *B65B 11/50* (2013.01)

(58) Field of Classification Search

CPC ..... B65B 55/24; B65B 11/52; B65B 9/045; B65B 11/50

See application file for complete search history.

(56) References Cited

U.S. PATENT DOCUMENTS

| | | | | |
|---|---|---|---|---|
| 3,490,193 | A * | 1/1970 | Eells | B65B 11/52 53/427 |
| 3,668,820 | A * | 6/1972 | Parvin | B65B 7/164 53/510 |
| 4,693,057 | A * | 9/1987 | Rittinger | B65B 9/045 53/247 |
| 2006/0230708 | A1* | 10/2006 | Granili | B65B 9/045 53/427 |
| 2012/0204516 | A1* | 8/2012 | Palumbo | B65B 41/06 53/403 |
| 2016/0128903 | A1* | 5/2016 | Uetake | B65B 51/16 206/531 |
| 2020/0071012 | A1* | 3/2020 | Mo Nang | B65B 57/02 |

* cited by examiner

*Primary Examiner* — David Redding

(74) *Attorney, Agent, or Firm* — Luedeka Neely Group, PC

(57) ABSTRACT

A vacuum cleaning unit for use with blister packaging includes a plate configured to closely overlie a conveyor having open blister packaging containing objects to be packaged, such as brushes. Angled slots on a lower portion of the plate apply full and uniform coverage of wells of the blister packaging as the packaging is indexed below the plate by the conveyor. Open areas of the plate are spaced apart by solid areas on either side of an open central area of the plate in flow communication with a source of vacuum or suction. The solid and open areas cooperate with the slots to direct air from the edges to the central suction area in a manner that keeps the objects in the wells more stable as they enter and exit the suction area.

7 Claims, 10 Drawing Sheets

VACUUM CLEANING UNIT FOR BLISTER PACKAGING

CROSS-REFERENCE TO RELATED APPLICATION

This application claims priority to U.S. Provisional Application No. 62/542,014 filed Aug. 7, 2017, entitled VACUUM CLEANING UNIT FOR BLISTER PACKAGING, incorporated herein by reference in its entirety.

FIELD

This disclosure relates to the field of blister packaging. More particularly, this disclosure relates to a vacuum cleaning unit for use in the provision of blister packaging.

BACKGROUND

Improvement is desired in the making of blister packaging. In the process of loading objects to be packaged in the wells of the blister packaging, debris, dust, stray matter and the like become present in the wells. Conventionally, a vacuum is applied in an attempt to remove such debris and matter. Typically, the vacuum is applied to the open wells and the vacuum is spaced away from the wells in order to avoid sucking the objects loaded in the wells out of the wells.

FIG. 1 shows a prior art cleaning unit. The prior art cleaning unit utilizes a low suction pressure, less than about 760 Torrs. The prior art unit also utilizes a low air velocity, less than about 255 cfm at 1300 fpm. Further, the prior art unit is configured to provide a large gap G between the wells of blister packaging P and the source of the vacuum, at least about 1.25 inches, to distance the wells from the source of vacuum so that the objects in the well are not sucked out of the wells.

It has been observed that such a conventional vacuum unit provides inadequate removal of debris and other matter from the wells and has other shortcomings. The present disclosure addresses such shortcomings of the prior art.

SUMMARY

The disclosure provides a vacuum cleaning unit.

In one aspect, the vacuum cleaning unit includes a source of vacuum pressure; and a conveyor having blister packaging with open wells containing objects. The conveyor is configured to convey the blister packaging below and past the source of vacuum pressure for application of vacuum pressure to the blister packaging to remove dust and debris from the open wells of the blister packaging.

The vacuum unit also includes a plate located in flow communication with the source of vacuum pressure and positioned to overlie the conveyor so that the blister packaging is conveyed below and past the plate. The plate has elongate slots on a lower surface of the plate, with open areas and a pair of solid areas above the elongate slots.

The open areas include a central suction area in direct flow communication with the source of vacuum pressure and a pair of lateral open areas exposed to atmospheric pressure. The lateral open areas are each located on an opposite side of the central suction area and spaced from the central suction area by one of the pair of solid areas of the plate. The solid and open areas cooperate with the elongate slots to direct air to flow from the atmosphere through the lateral open areas and through the elongate slots to the central suction area.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
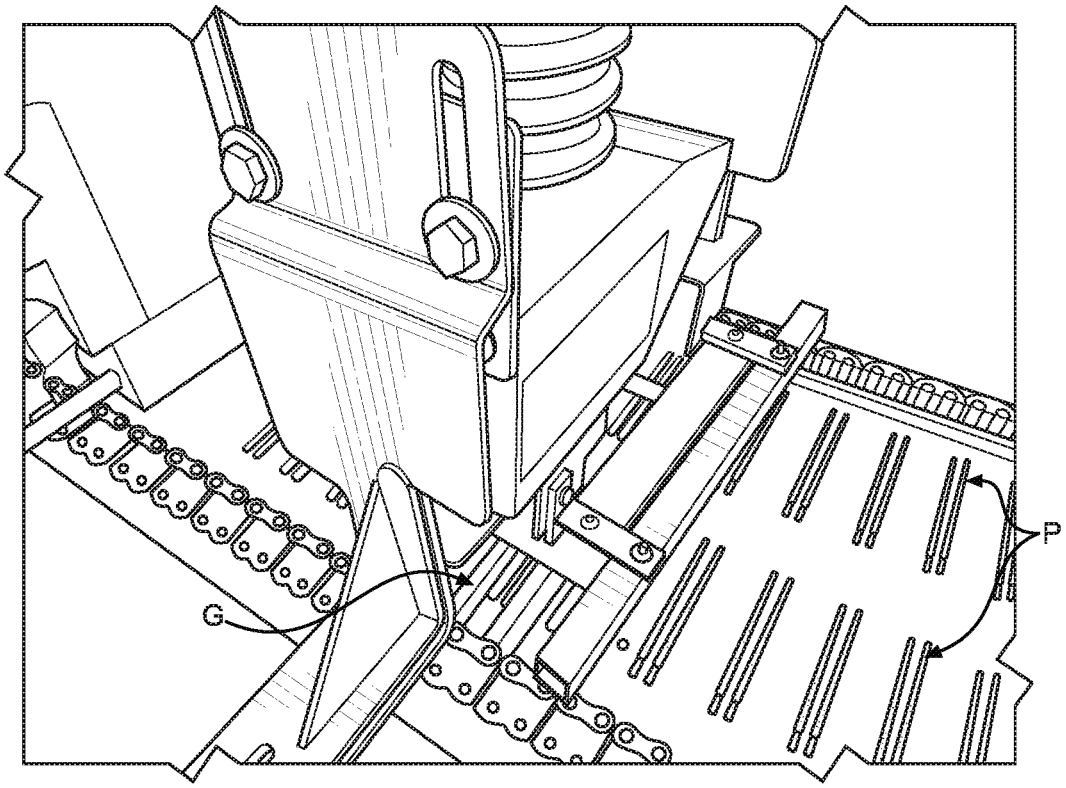
FIG. 1 PRIOR ART
FIG. 1 shows a prior art vacuum cleaning unit.

With initial reference to FIGS. 2-5, there is shown a vacuum cleaning unit 10 according to the disclosure and for use in cleaning blister packaging.

As shown, the 10 unit includes a plate 12 configured to closely overlie a conveyor 14 having open blister packaging 16 containing objects 18 such as brushes to be packaged. Above the conveyor 14 is a source of vacuum 20. The source of vacuum 20 is located to have a suction inlet 20*a* located adjacent the plate 12. As detailed below, the unit 10 having the plate 12 enables use of higher suction pressures and air velocities and eliminates the requirement of a gap between the suction and the packaging.

As compared to conventional devices the unit 10 according to the disclosure uses significantly higher suction pressures, preferably of from about 750 to about 760 Torrs. In addition, the unit 10 according to the disclosure also utilizes significantly higher air velocities, preferably from about 880 to about 980 cfm at 4,500 to 5,000 fpm.

Figure 2:
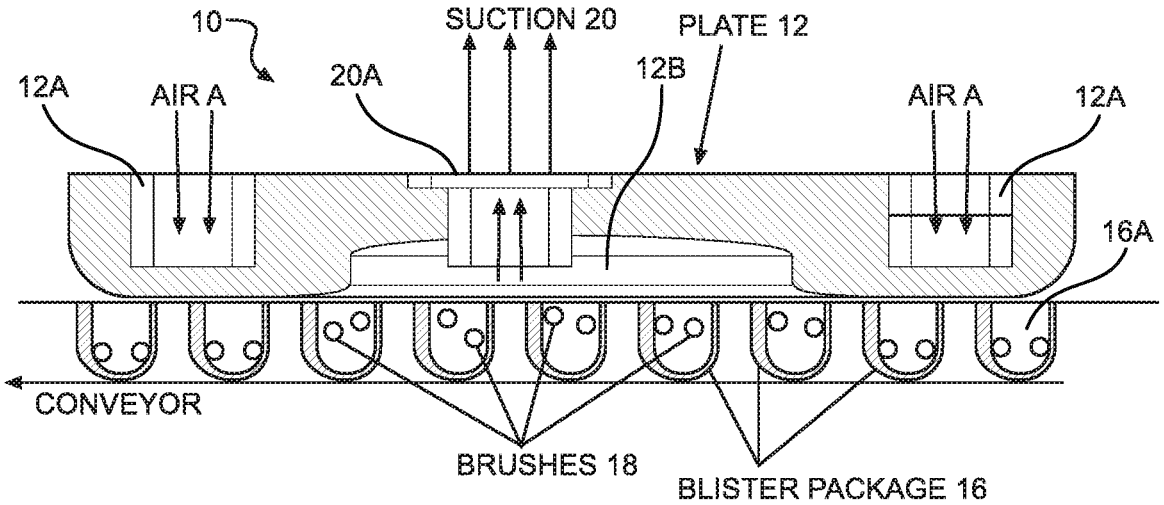
FIGS. 2-5 shows a vacuum cleaning unit for blister packaging according to the disclosure.
Figure 3:
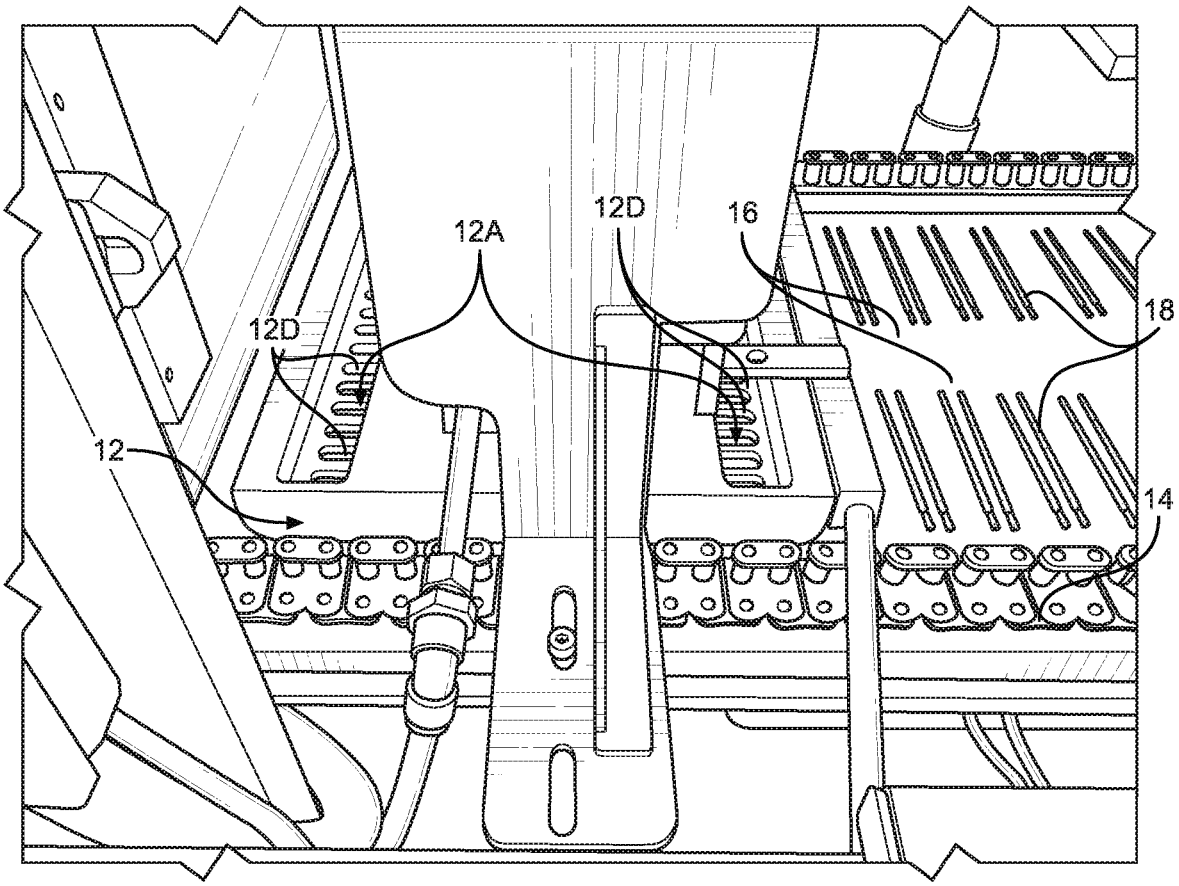
Figure 4:
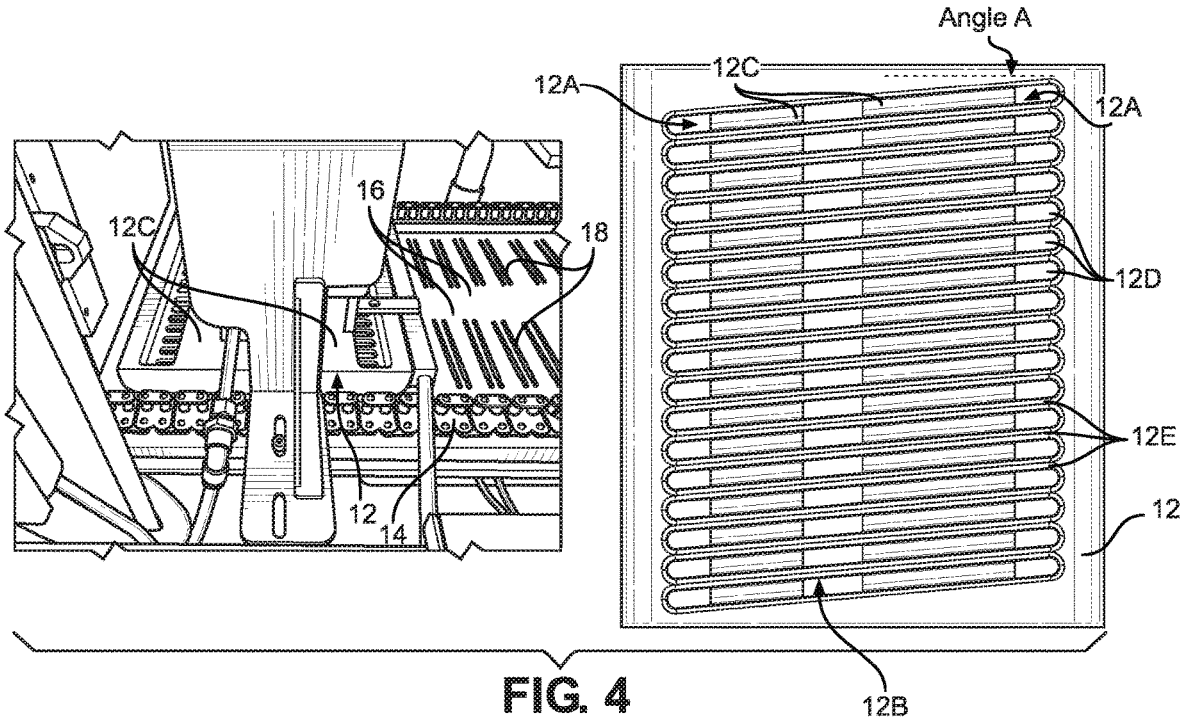
Figure 5:
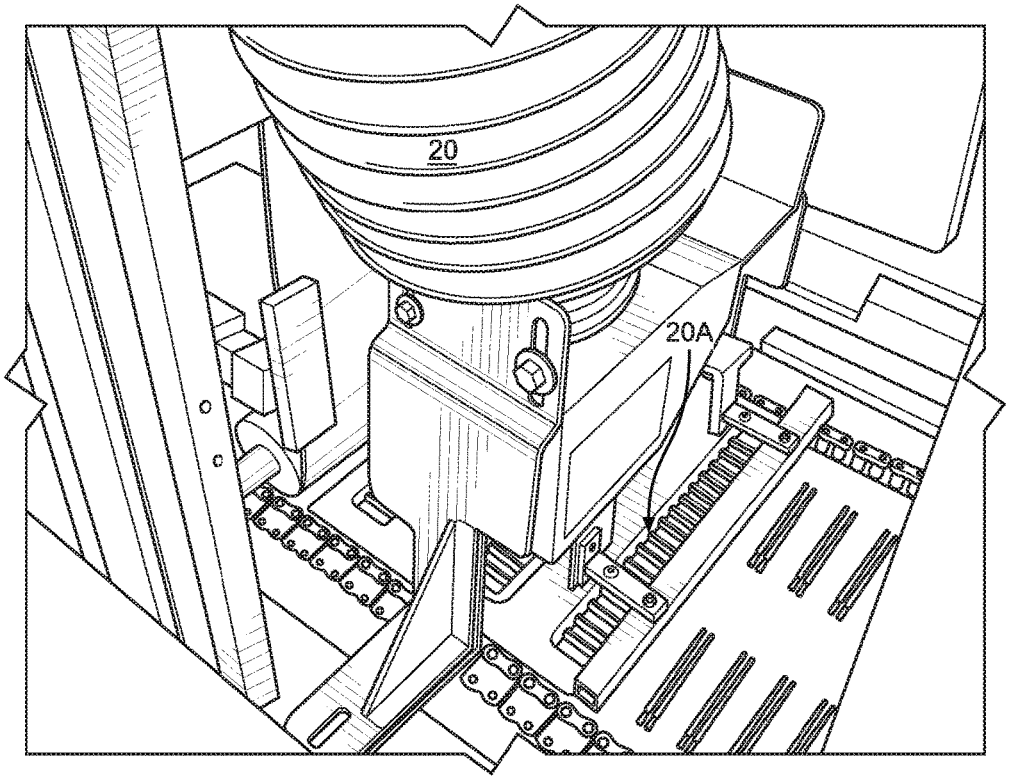
Figure 6:
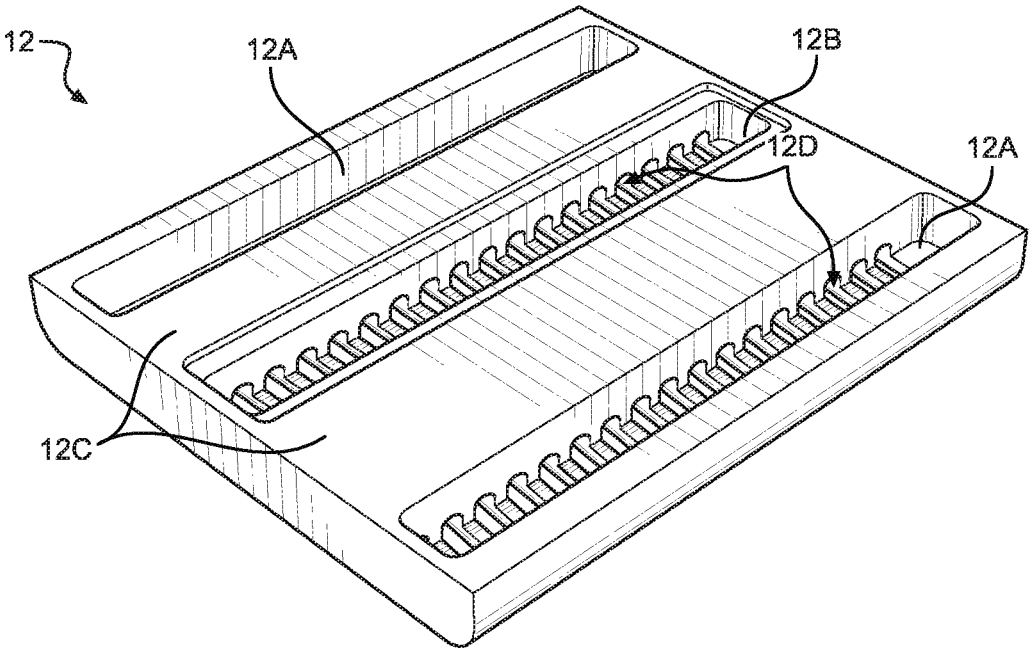
FIGS. 6-11 show details of a plate component of the vacuum cleaning unit according to the disclosure.
Figure 7:
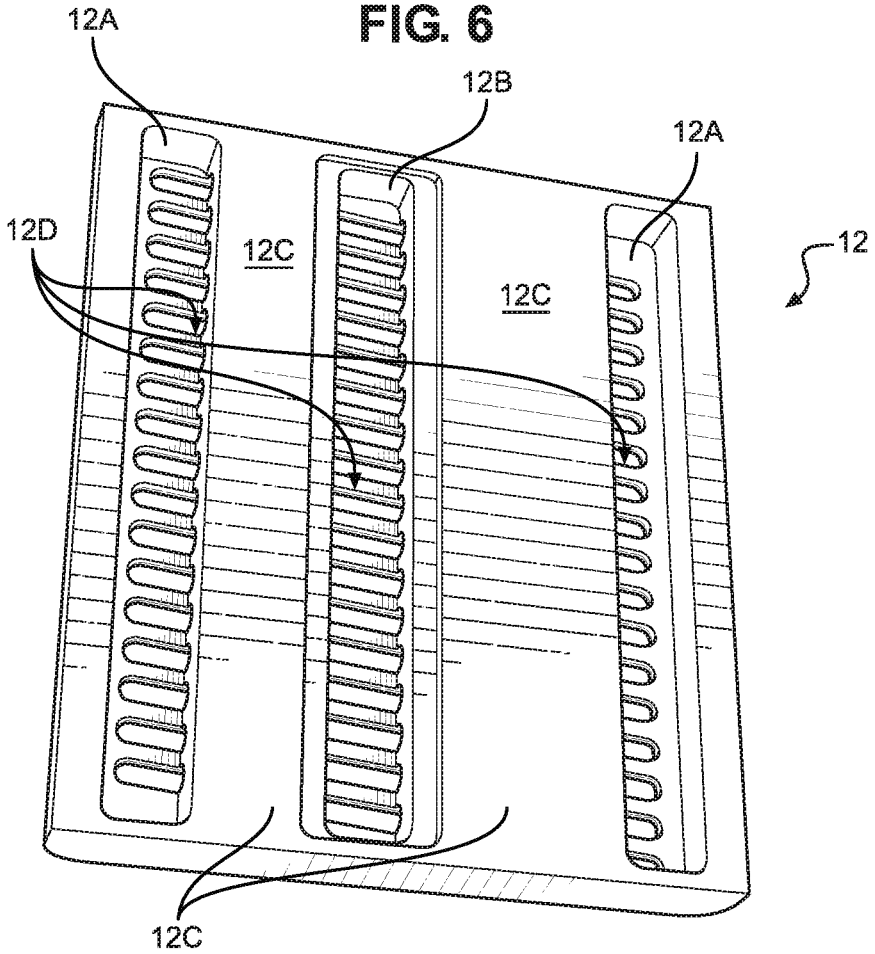
Figure 8:
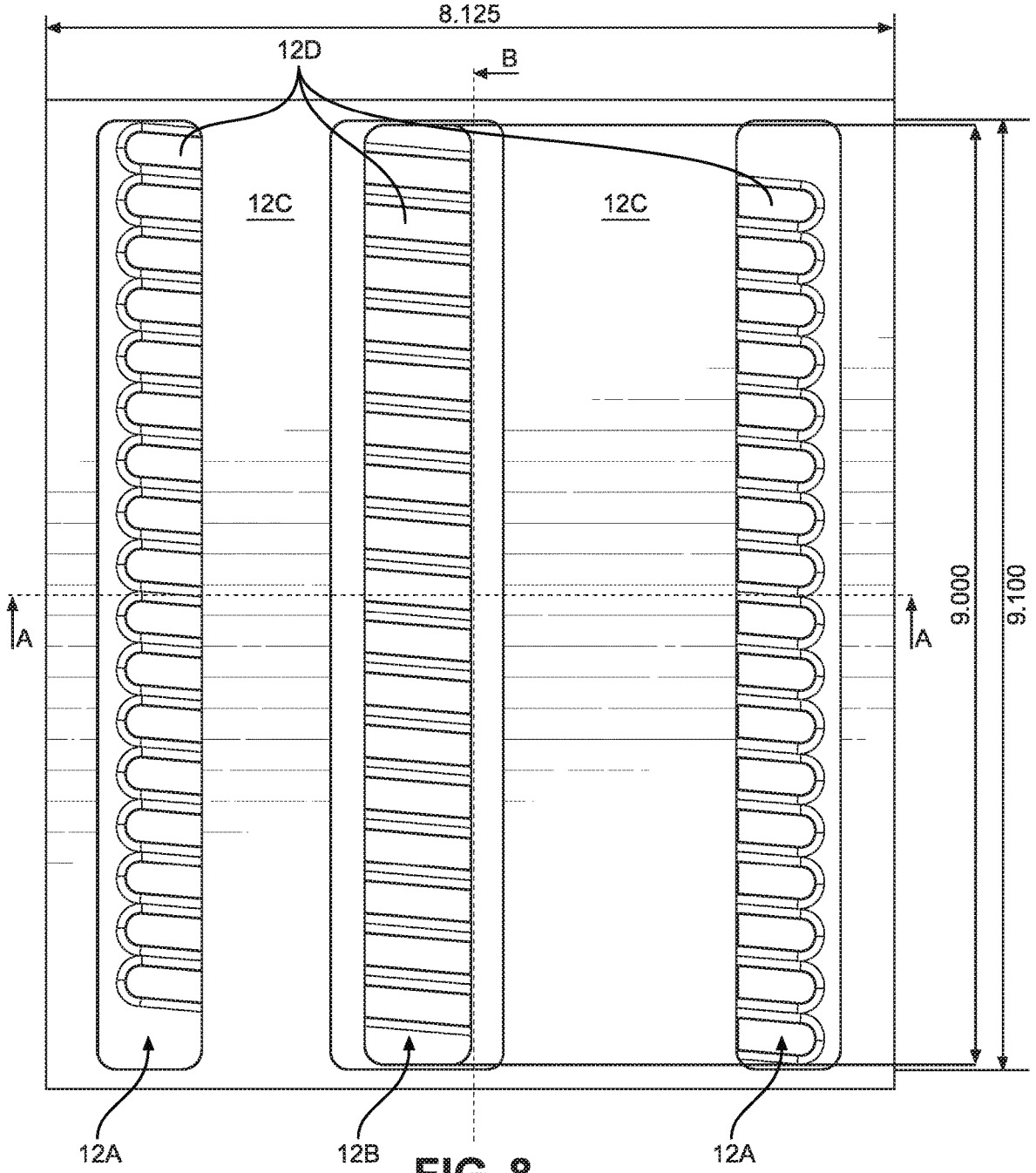
Figure 9:
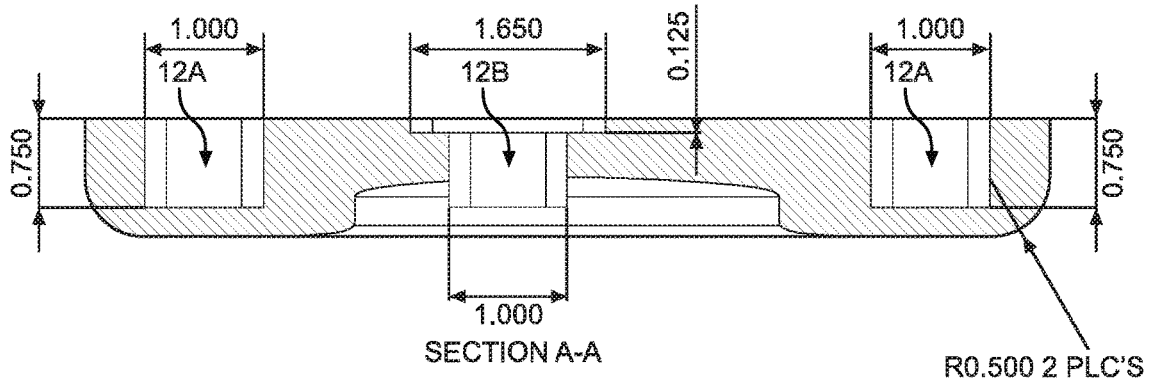
Figure 10:
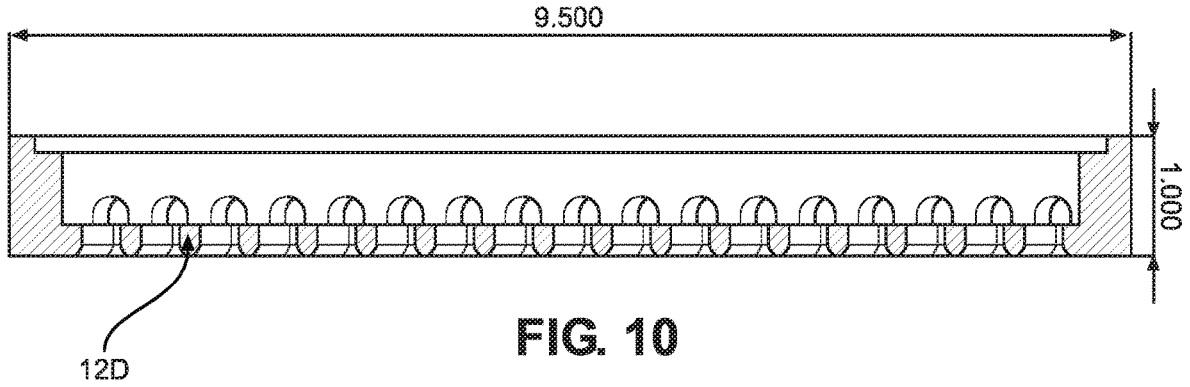
Figure 11:
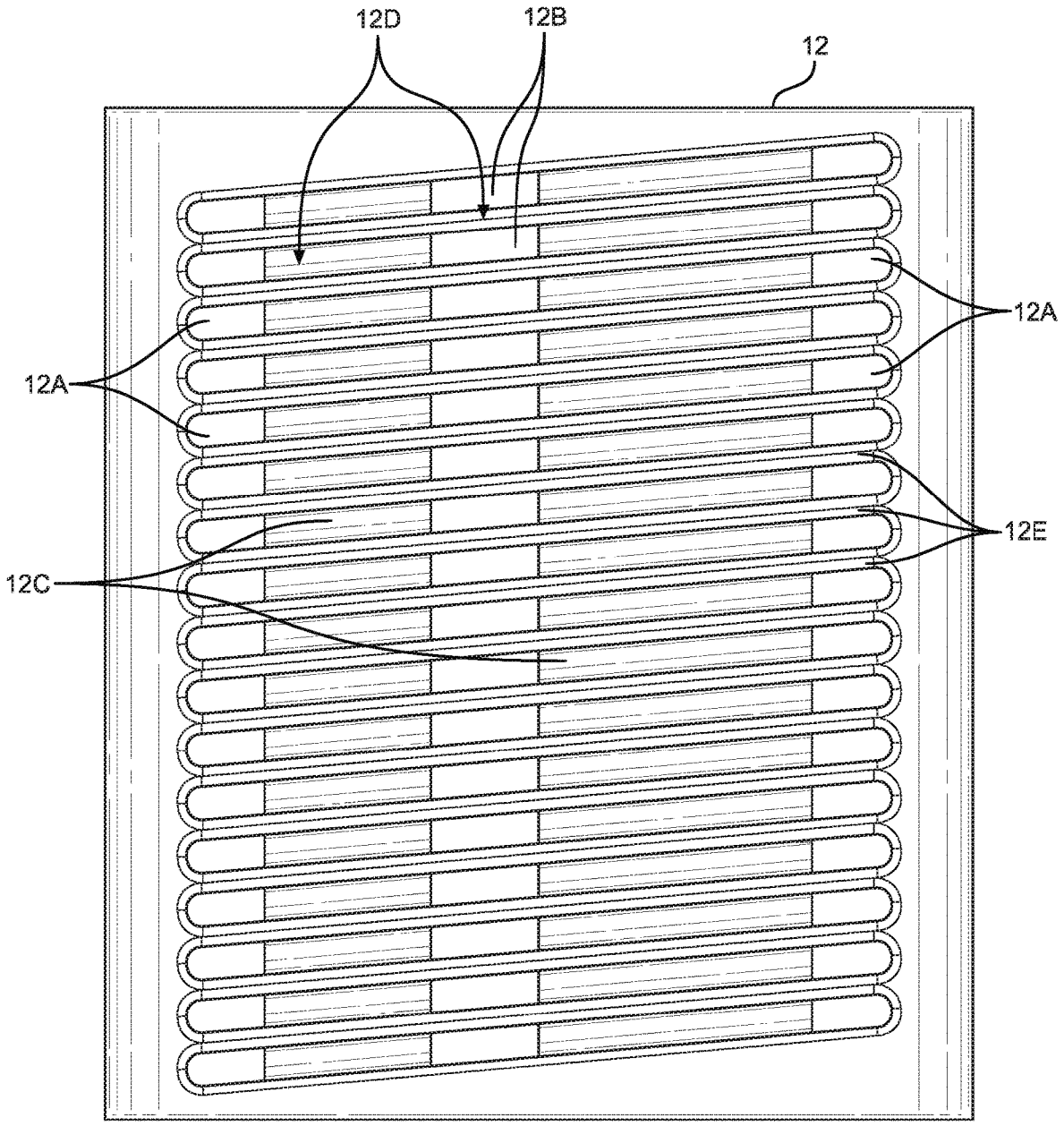

Further, the unit 10 is configured to avoid having a gap between the blister packaging 16 and the source of vacuum 20. As shown in FIG. 2, the vacuum source 20 rests against the plate 20 and suction is applied directly to the packaging 18 via the suction chamber 12*b*. Thus, the vacuum source applies vacuum directly to the suction chamber 12*b* and this in turn is applied directly to the packaging 16, thereby eliminating a gap, such as the gap G shown in the prior art apparatus of FIG. 1.

In operation of the vacuum cleaning unit 10, ambient air A enters via lateral open areas or inlets 12*a* of the plate 12 and travels to a central suction chamber 12*b* where the air exits under vacuum to apply a suction force to the open blister packaging 16 to move and lift the brushes or other objects 18 to enhance air flow and thus vacuum removal of debris and the like from the packaging. As described more fully below, the plate 12 is configured to retain the brushes or other objects 18 within the packaging during vacuum cleaning. The cleaned open blister packaging is then transferred by the conveyor 14 to another station to apply a covering to seal the open blister packaging 16.

With additional reference to FIGS. 6-11, additional details of the plate 12 are shown. The plate 12 is desirably made of an anti-static material, such as an acetal copolymer to provide rigidity, strength, and anti-static attributes to the plate 12. The plate 12 is configured so that multiple ones of the wells 16*a* may be vacuumed in a mechanized manner.

The plate 12 is configured to provide the inlets 12*a* as a pair of lateral open areas spaced apart by solid areas 12*c* on either side of the central suction chamber 12*b*. The central suction chamber 12*b* is provided by an open central area of the plate 12. The central suction chamber 12*b* is in direct flow communication with the source of vacuum 20. The inlets 12*a* are exposed to the atmosphere.

The plate 12 also includes angled slots 12*d* on a lower surface thereof oriented to apply full and uniform coverage of wells 16*a* of the blister packaging 16 as the packaging is indexed below the plate 12 by the conveyor 14. As shown, the slots 12*d* are angled across and relative to the inlets 12*a* and the central suction chamber 12*b*. The angled structure of the slots 12*d* is important to maximize the length of the slots 12*d* and hence the surface area of the slots 12*d*. Solid bars 12*e* are located between the slots 12*d*.

The slots 12*d* and the bars 12*e* are sized, spaced and angled with respect to the size of the wells 16*a* in a way that two or more of the bars 12*e* are always positioned over the objects to keep them from being lifted out of the wells by the vacuum. The angle of the slots 12*d* is such that the lateral displacement of the center line of the slot over the distance of the length of the slots is equal to at least the sum of the slot width and bar width. The effect is that as the wells 16*a* pass under the slots 12*d*, all portions of the well 16*a* are directly exposed to unobstructed vacuum air flow at some point in time.

The slots 12*d* are located side by side and preferably each have a width of from about 0.250 to about 0.35 inches. The slots 12*d* each have a length of from about 3 to about 5 inches and are oriented at a slot angle A with respect to the travel of the wells 16*a* of from about 5 to about 10 degrees. The bars 12*e* each preferably have a width of from about 0.05 to about 0.2 inches.

The solid areas 12*c* and the open areas provided by the inlets 12*a* and chamber 12*b* cooperate with the slots 12*d* to direct air from the edges of the plate 12 to the central suction chamber 12*b* in a manner that keeps the objects 18 in the wells 16*a* more stable as they pass under and exit from under the suction chamber 12*b*. That is, the suction pressure is greatest directly underneath the suction chamber 12*b*. This is depicted in FIG. 2, where in the objects/brushes 18 underneath the suction chamber 12*b* tend to experience sufficient suction forces to cause them to move around due to the suction forces, while the adjacent object/brushes 18 under the plate 12 but not directly under the suction chamber 12*b* experience less movement or effect from the suction forces. As seen, the objects 18 in the wells 16*a* underneath the suction chamber 12 are shown as being raised from the bottom of the wells 16*a* and moving, whereas the objects in the wells 16*a* under the plate 12 but not directly underneath the chamber 12*b* are generally at rest in the wells 16*a*.

The plate 12 also advantageously provides a structure that avoids having a gap between the source of vacuum 20 and the wells 16*a* of the blister packaging 16 to maximize the application of air suction to the wells 16*a* to remove dust, debris and other matter. The plate 12 is flush to the wells 16*a* and holds the wells 16*a* steady and keeps the objects 18 in the wells 16*a*, such as brushes, from leaving the wells while promoting movement of the objects by the suction forces to enable debris and matter under the objects to be freed and removed by the suction.

The conveyor 14 is a motorized and computer-controlled belt configured to convey the objects 18 below the plate 12 for application of suction thereto. The conveyor 14 is preferably operated to index the wells 16*a* for a residence time of each of the wells 16*a* below the chamber 12*b* for a period of time of from about 4.5 to about 5.0 seconds.

The blister packaging 16 is depicted in FIGS. 12A-17. The packaging 16 has a plurality of the open plastic wells 16*a* into which the objects 18, such as brushes or other objects are loaded. Perforations 16*b* bridge the wells 16*a* so they may be separated from one another.

Figure 12A:
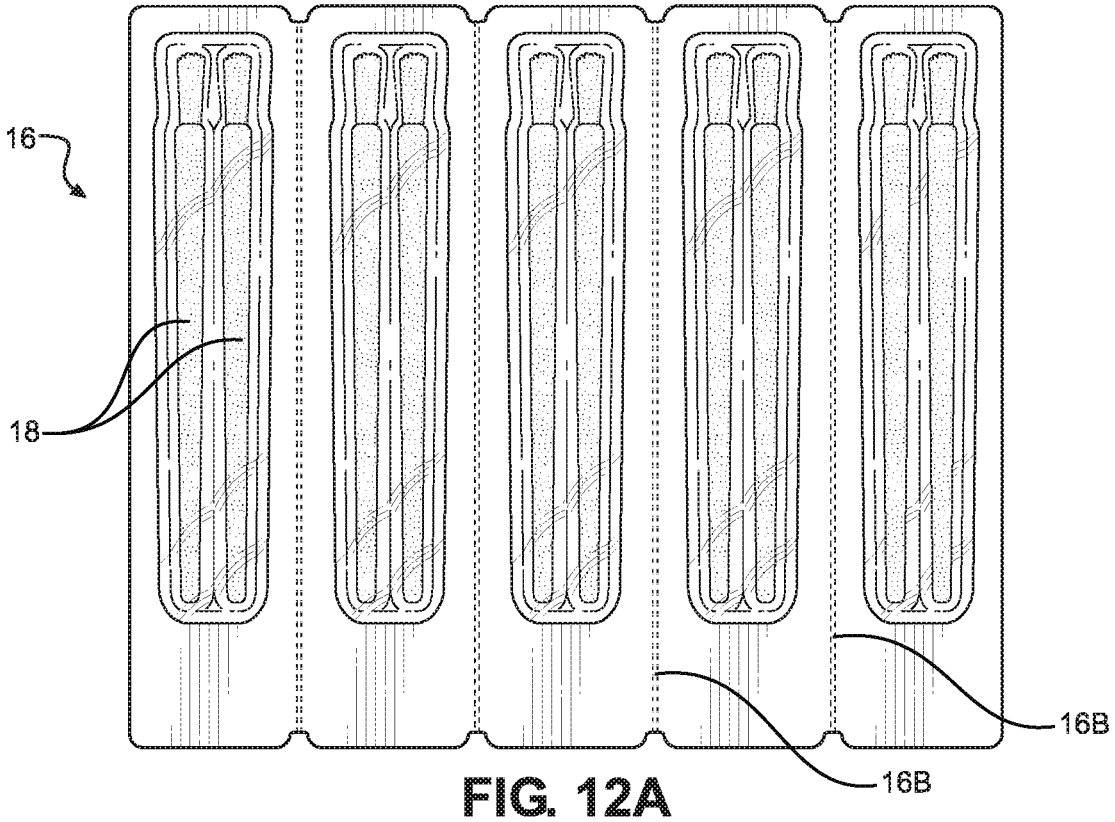
FIGS. 12A-17 shows blister packaging of the type utilized with the vacuum cleaning unit of the disclosure.
Figure 12B:
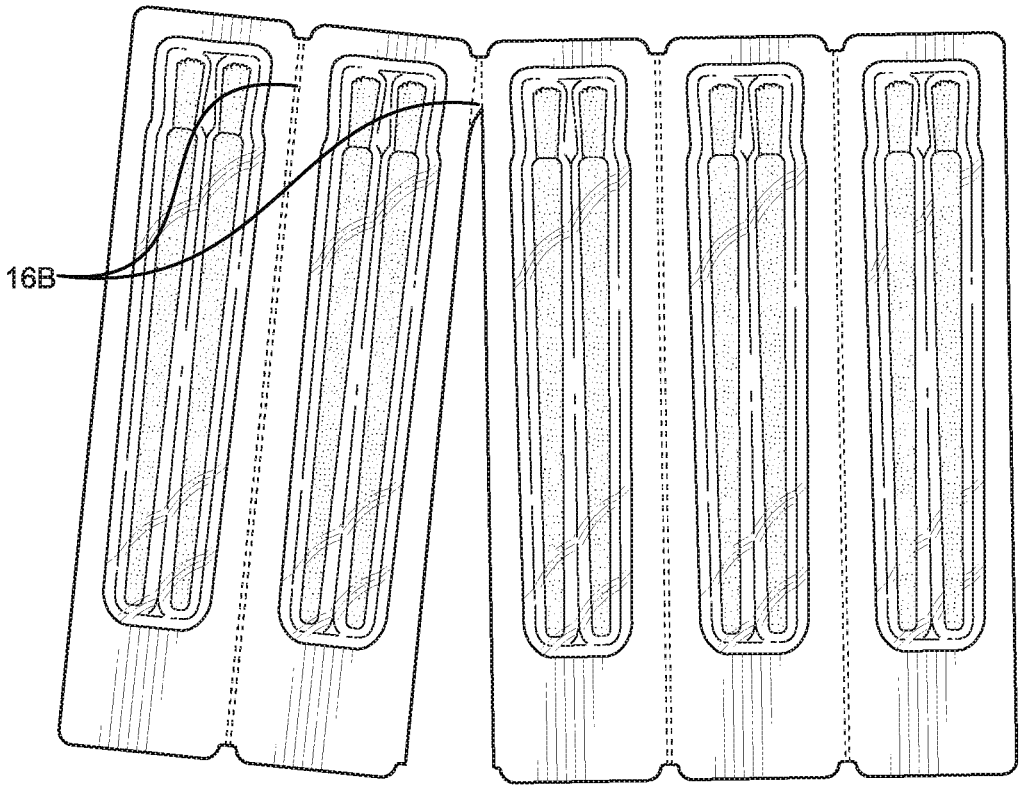
Figure 13:
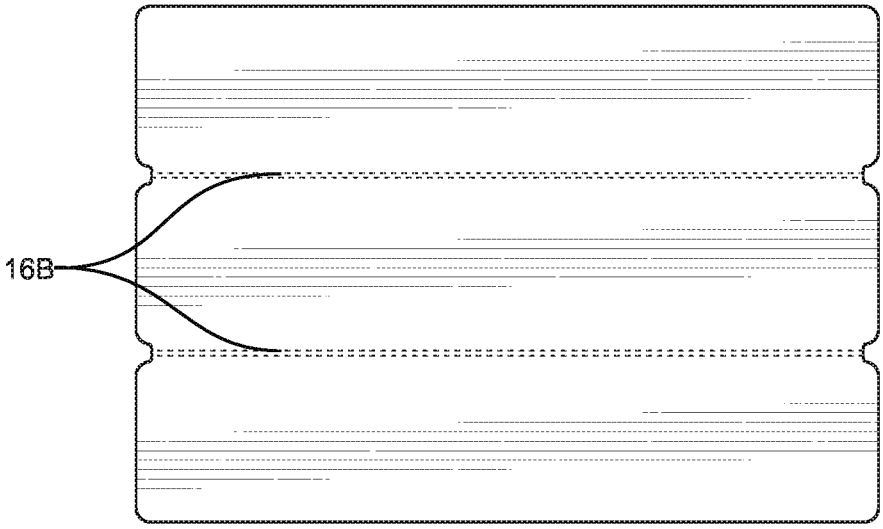
Figure 14:
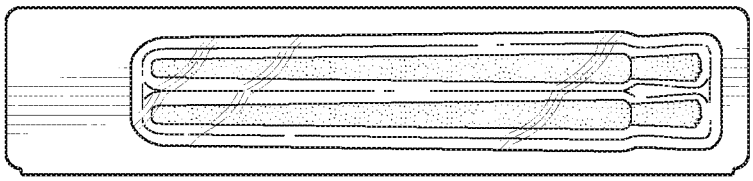
Figure 15:
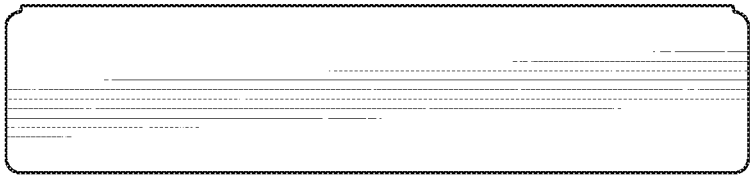
Figure 16:
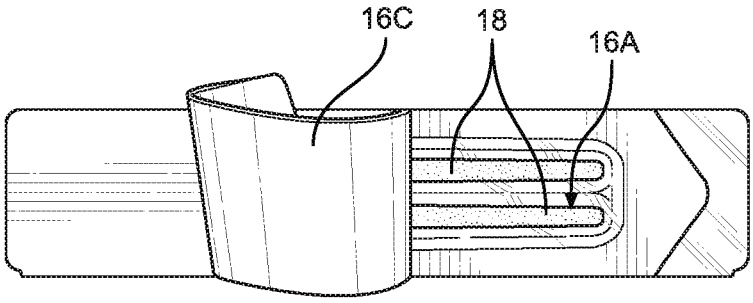
Figure 17:
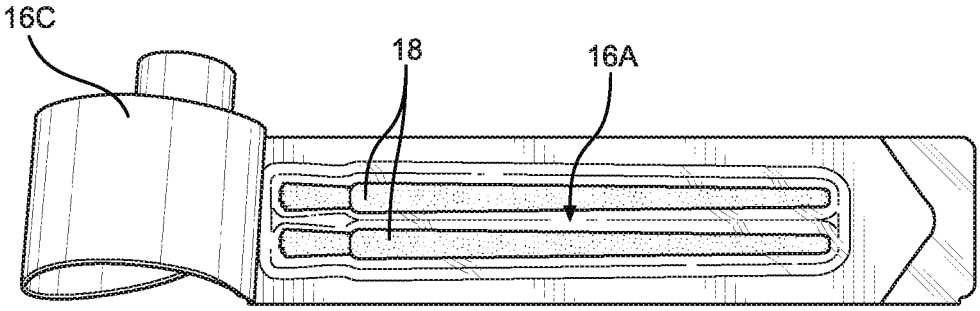

In the loading process, debris including plastic flash, dust, and stray brush bristles become present in the wells 16*a*. The vacuum unit 10 removes this debris for hygienic and visual display purposes. After cleaning, a film covering 16*c* is adhered to the open wells 16*a*. FIG. 12A shows a string of completed blister packaging. FIG. 12B shows separation of adjacent packaging along one of the perforations 16*b*. FIG. 13 is a bottom view of completed packaging. FIG. 14 is a top view of a single package and FIG. 15 is a bottom view thereof. FIGS. 16 and 17 depict subsequent removal of the covering from a single blister packaging to access the brushes or other objects 18 in the well 16*a* of the packaging 16.

The objects 18 are depicted as small brushes of the type utilized to apply mascara, makeup, and other cosmetics. The brushes have a handle and bristles attached to the handle. Often, loose bristle material can make up debris in the wells 16*a* of the packaging. The brushes weigh from about 0.8 to about 1.0 ounces. The cleaning unit 10 and the process conditions described here have been found suitable for use with objects such as the described brushes.

The source of vacuum 20 is a vacuum unit configured to supply suction pressures, preferably of from about 750 to about 760 Torrs with the velocity of the suction air ranging from about 880 to about 980 cfm at 4,500 to 5,000 fpm. The source of vacuum 20 preferably operates continuously.

The present disclosure advantageously provides an improved vacuum cleaning unit for removing debris and the like from packaging wells of small objects such as brushes. The vacuum unit advantageously enables the use of higher vacuum pressures and velocities with improved results without the undesirable effects of such higher pressures and velocities in sucking the objects from the vacuum wells.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A vacuum cleaning unit, the cleaning unit comprising:

a source of vacuum pressure;

a conveyor having blister packaging with open wells containing objects, the conveyor configured to convey the blister packaging below and past the source of vacuum pressure for application of vacuum pressure to the blister packaging to remove dust and debris from the open wells of the blister packaging; and a plate located in flow communication with the source of vacuum pressure and positioned to overlie the conveyor so that the blister packaging is conveyed below and past the plate, the plate having elongate slots on a lower surface of the plate, with open areas and a pair of solid areas above the elongate slots, the open areas comprising a central suction area in direct flow communication with the source of vacuum pressure and a pair of lateral open areas exposed to atmospheric pressure, the lateral open areas each being on an opposite side of the central suction area and spaced from the central suction area by one of the pair of solid areas of the plate, wherein the solid and open areas cooperate with the elongate slots to direct air to flow from the atmosphere through the lateral open areas and through the elongate slots to the central suction area.

2. The vacuum unit of claim 1, wherein the slots are angled across and relative to the lateral open areas and the central suction area.

3. The vacuum unit of claim 2, wherein the wells travel in a direction and the slots are angled at an angle of from about 5 to about 10 degrees relative to the direction of travel of the wells.

4. The vacuum unit of claim 1, wherein the plate is configured to maintain the objects within the open wells during vacuum cleaning.

5. The vacuum unit of claim 1, wherein the source of vacuum pressure supplies suction pressures of from about 750 to about 760 Torrs at an air velocity of from about to about 880 to 980 cfm at 4,500 to 5,000 fpm.

6. The vacuum unit of claim 1, wherein the objects each have a weight of from about 0.8 to about 1.0 grams.

7. The vacuum unit of claim 1, further comprising a solid bar between adjacent ones of the slots.

* * * * *